US007511599B2

(12) United States Patent
Ye et al.

(10) Patent No.: US 7,511,599 B2
(45) Date of Patent: Mar. 31, 2009

(54) COIL STRUCTURE FOR HIGH FREQUENCY TRANSFORMER

(75) Inventors: Hao-Yi Ye, Shanghai (CN); Jia-Ping Chen, Shanghai (CN); Hong-Shan Tao, Shanghai (CN); Jian-Ping Ying, Shanghai (CN); Zhong Chen, Shanghai (CN); Jing-Fei He, Shanghai (CN); Feng Li, Shanghai (CN); Hong-Jian Gan, Shanghai (CN)

(73) Assignee: Delta Electronics, Inc., Taoyuan Hsien (TW)

( * ) Notice: Subject to any disclaimer, the term of this patent is extended or adjusted under 35 U.S.C. 154(b) by 0 days.

(21) Appl. No.: 11/936,930

(22) Filed: Nov. 8, 2007

(65) Prior Publication Data

US 2008/0122569 A1 May 29, 2008

(30) Foreign Application Priority Data

Nov. 27, 2006 (TW) ..... 95143858 A

(51) Int. Cl.
*H01F 5/00* (2006.01)
*H01F 27/28* (2006.01)

(52) U.S. Cl. ..... 336/200; 336/223; 336/232

(58) Field of Classification Search ..... 336/200, 336/223, 232
See application file for complete search history.

(56) References Cited

U.S. PATENT DOCUMENTS

| | | | | |
|---|---|---|---|---|
| 6,222,437 | B1 * | 4/2001 | Soto et al. | 336/200 |
| 6,573,822 | B2 * | 6/2003 | Ma et al. | 336/223 |
| 6,577,220 | B2 | 6/2003 | Liu et al. | |
| 7,199,693 | B2 * | 4/2007 | Matsutani et al. | 336/200 |

* cited by examiner

*Primary Examiner*—Anh T Mai
(74) *Attorney, Agent, or Firm*—Volpe and Koenig, P.C.

(57) ABSTRACT

The present invention provides a continuous conductive planar coil structure. The continuous conductive planar coil structure includes a first output terminal, a second output terminal, a coil body and a projection plane parallel to the coil body, wherein a first projection on the projection plane is formed by the first output terminal, a second projection on the projection plane is formed by the second output terminal, and an overlapping portion is between the first projection and the second projection.

19 Claims, 18 Drawing Sheets

15

COIL STRUCTURE FOR HIGH FREQUENCY TRANSFORMER

FIELD OF THE INVENTION

This invention relates to a continuous conductive planar coil structure, and more particularly to a coil structure for a high efficiency transformer.

BACKGROUND OF THE INVENTION

As most electrical power products, the development trend of a DC/DC converter is to form a converter with high efficiency, high power density, high reliability and low cost.

For a DC/DC converter outputting low voltage and high current, it is important to optimize the design of a transformer in order to meet the above-mentioned development trend. And due to the requirement of high efficiency at higher and higher output current, the secondary side coil of a transformer is changed from conventional winding type coil to a strip type continuous conductive planar type coil.

Please refer to FIG. 1, which is disclosed in U.S. Pat. No. 6,577,220 to show a perspective view of coil structure. As shown in FIG. 1, the coil structure 1 is made by folding a strip type continuous conductive structure. In comparison with the conventional winding type structure, the coil structure shown in FIG. 1 has a reduced DC resistance and an increased heat-dissipating area, so that the conduction loss of the transformer is significantly reduced.

For high power density, the switching frequency of a circuit is increased so as to reduce the volume of a magnetic component. However, there are some problems when the coil structure shown in FIG. 1 is used in a high frequency condition.

With the increasing frequency, the skin effect and the proximity effect of the AC current in a conductor are more severe, so that the AC loss is correspondingly increased. In addition, the electromagnetic radiation will generate from a circuit owing to the improper layout, so that the power density and the reliability are disadvantageously affected owing to the electromagnetic interferences.

When the coil structure shown in FIG. 1 is used in the high frequency condition, high frequency current with reverse directions flow through the output terminals (such as output terminals 11, 12) of the coil structure. When the output terminals are very close, current concentrates on the two sides proximate each other owing to the coupling of electromagnetic fields therebetween, which is the proximity effect, and therefore the current is distributed unevenly which increases the power loss. Furthermore, there is an interval 10 between the two output terminals 11 and 12, so that there is the electromagnetic interference produced from the interval 10 to surroundings, and the circuit is also interfered with the electromagnetic radiation in the surroundings.

Please refer to FIG. 2, which is a block diagram showing a DC/DC converter according to the prior art. In FIG. 2, the DC/DC converter includes an input circuit 21, a transformer 22 and an output circuit 23. In addition, there are two output terminals 24 and 25 on the secondary side of the transformer 22, and a loop 26 is formed by the output terminals 24, 25 and the output circuit 23. The current doubler rectifier circuit, the voltage doubler rectifier circuit, the full-bridge rectifier circuit and the half-wave rectifier circuit have the above-mentioned structures, and the characteristics thereof are those the current flowing into the output terminal 24 of the transformer 22 has the identical quantities and reverse directions with the current flowing out of the output 25 of the transformer 22, and the current in the loop 26 is high efficiency AC current. According to the electromagnetic field theory, the loop passing the high frequency AC current therethrough produces the high frequency magnetic field (magnetic field H in FIG. 2), which emits the electromagnetic wave to interfere surroundings. In addition, the electromagnetic radiation in the surroundings can also be received by the loop 26, so as to interfere the circuit itself. Therefore, in order to reduce the electromagnetic radiation in the surroundings and to reduce the interference in the circuit, the area of the loop 26 should be significantly reduced.

Please refer to FIG. 3, which is a block diagram showing another DC/DC converter according to the prior art. In FIG. 3, the DC/DC converter 3 includes an input circuit 31, a transformer 32 and an output circuit 33. In FIG. 3, the transformer 32 has a center-tapped structure, and there are three output terminals 34, 35 and 36 on the secondary side of the transformer 32. The first loop 37 is formed by the output terminals 35, 36 and the output circuit 33 on the secondary side of the transformer 32. The second loop 38 is formed by the output terminals 34, 36 and the output circuit 33 on the secondary side of the transformer 32. The third loop 39 is formed by the output terminals 34, 35 and the output circuit 33.

When the current is flowing in one (such as the loop 37) of the loops, the current flowing in the output terminal 35 and the current flowing out of the output terminal 36 have identical quantities and reverse directions. When the current flows in the loop 38, the current in the output terminal 34 and the current in the output terminal 36 have identical quantities and reverse directions. The current in the output terminal 34 and the current in the output terminal 35 have identical quantities and the phase difference of 180°. And the odd-order harmonics of the AC component of the current in the output terminal 34 and 35 have identical quantities and reverse directions. The center tapped full-wave rectifier circuit has the above-mentioned structure. Similarly, in order to reduce the electromagnetic radiation in the surroundings and to reduce the interference in the circuit, the areas of the loops 37, 38 and 39 should be significantly reduced, i.e. the outputs 34, 35 and 36 should be very close which can also alleviate the unevenly distribution of the current due to proximity effect.

Please refer to FIG. 4(*a*) showing a voltage type full-wave rectifier circuit according to the prior art. As shown in FIG. 4(*a*), the full-wave rectifier circuit 4 includes switches S1, S2 connected to the secondary side of the transformer T and connected to the output inductor L, wherein the output inductor L is connected to the positive terminal of the output capacitor Co, and the negative terminal of the output capacitor Co is connected to the center tap on the secondary side of the transformer T.

When the full-wave rectifier circuit shown in FIG. 4(*a*) is used in a pulse width modulation (PWM) circuit, the waveforms of the current passing through the switches and the center tap (i.e. the output inductor L) is shown in FIG. 4(*b*).

In FIG. 4(*b*), the current passing through the switch S1 is denoted as $i_1$, the current passing through the switch S2 is denoted as $i_2$, and the current passing the center tap is denoted as $i_3$.

FIG. 4(*c*) is a diagram showing the harmonic spectra of the current $i_3$. FIG. 4(*d*) is a diagram showing the harmonic spectra of the currents $i_1$ and $i_2$ passing through the switches S1 and S2. FIG. 4(*c*) and FIG. 4(*d*) show a ratio of the harmonic frequency to the switch frequency versus a ratio of the harmonic amplitude to the output current. As shown in FIGS. 4(*c*) and 4(*d*), the AC component of the current $i_3$ is a very small part of the total current and has the even-order harmonics, and the odd-order harmonic of the current passing through the switches S1 and S2 is the major part of the total current.

Therefore, there is a need to provide different coil structures for secondary side rectification circuits of various transformers in order to overcome the aforesaid drawbacks of the transformer used in the high frequency condition.

Accordingly, in order to overcome the disadvantages of the prior art described above, the present invention provides a continuous conductive planar coil structure for a high frequency transformer.

SUMMARY OF THE INVENTION

It is an aspect of the present invention to provide a continuous conductive planar coil structure. The continuous conductive planar coil structure includes a first output terminal, a second output terminal, a coil body and a projection plane parallel to the coil body, wherein a first projection on the projection plane is formed by the first output terminal, a second projection on the projection plane is formed by the second output terminal, and an overlapping portion is formed by the first projection and the second projection.

Preferably, the first projection has a first area, the second projection has a second area, the overlapping portion has a third area, and one of a ratio of the third area to the first area and a ratio of the third area to the second area is more than 10%.

Preferably, a third projection on the projection plane is formed by the coil body, and a fourth projection is formed by the first projection and the second projection, wherein a first boundary is between the fourth projection and the third projection, the fourth projection has a second boundary, the first boundary and the second boundary intersect at a first point and a second point, the third projection is symmetric relatively to a first axis passing through the fourth projection, a second axis parallel to the first axis passes through the first point, and a third axis parallel to the first axis passes through the second point. The continuous conductive planar coil structure further includes a first switch having a first end connected to the first output terminal and having a projection with a third boundary on the projection plane, a second switch having a second end connected to the second output terminal and having a projection with a fourth boundary on the projection plane, wherein a horizontal line perpendicular to the first axis crosses one of the third boundary and the fourth boundary, and a distance between the first horizontal line and the first point is relatively minimal. The continuous conductive planar coil structure further includes a fifth projection demarcated by the first boundary, the second axis, the third axis and the first horizontal line, and a ratio of an area of the overlapping portion to an area of the fifth projection being more than 5%.

Preferably, the continuous conductive planar coil structure includes a sixth projection demarcated by the first boundary, the second boundary, the second axis, the third axis and the horizontal line, and a ratio of the area of the overlapping portion to an area of the sixth projection is more than 5%.

It is another aspect of the present invention to provide a continuous conductive planar coil structure including a continuous conductive path positioned between the first output terminal and the second output terminal. The continuous conductive path includes a first three-fourths circular path connected to the first output terminal, a second three-fourths circular path connected to the second output terminal, and a first half-circular path connected between the first three-fourths circular path and the second three-fourths circular path for separating the first three-fourths circular path and the second three-fourths circular path on an extending direction of the continuous conductive path, wherein the first half-circular path has an opening toward a first direction, the first output terminal and the second output terminal are toward a second direction, and the first direction is opposite to the second direction, wherein non-contact folding of the first three-fourths circular path, the second three-fourths circular path and the first half-circular path are horizontally formed on junctions among the first three-fourths circular path, the second three-fourths circular path and the first half-circular path, so that a first circular projection is vertically formed by the first three-fourths circular path, the second three-fourths circular path and the first half-circular path. The first projection and the second projection substantially completely overlap each other.

Preferably, there are at least two path units respectively disposed between the first three-fourths circular path and the first half-circular path and between the second three-fourths circular path and the half-circular path on the extending direction of the continuous conductive planar path for separating the first three-fourths circular path and the second three-fourths circular path. Each of the path units includes a second half-circular path, and a third half-circular path connected to the second half-circular path, wherein adjacent half-circular paths between the first three-fourths circular path and the second three-fourths circular path respectively have a third opening toward a third direction and a fourth opening toward a fourth direction opposite to the third direction, and non-contact folding of the first three-fourths circular path, the second three-fourths circular path and the half-circular paths are horizontally formed on junctions among the first three-fourths circular path, the second three-fourths circular path and the half-circular paths, so that a second circular projection is vertically formed by the first three-fourths circular path, the second three-fourths circular path and the half-circular paths.

Preferably, the continuous conductive planar coil structure includes a first switch connected to the first output terminal and a second switch connected to the second output terminal.

It is another aspect of the present invention to provide a coil structure for a high frequency transformer, in which the coil structure is used on a secondary side of the transformer. The coil structure includes a plurality of the above-mentioned continuous conductive planar coil structures, wherein the first switch and the second switch mutually connect to a first connecting plate, and the first connecting plate provides an electrical connection between the first switch and the second switch.

Preferably, the coil structure includes a second connecting plate connected to the first switch and the second switch, wherein said second connecting plate comprises a control circuit, an absorption circuit and a protection circuit thereon.

Preferably, the coil structure includes a third output terminal wherein a third projection on the projection plane is formed by the third output terminal.

Preferably, the third projection is not overlapped with the overlapping portion.

Preferably, the third projection is overlapped partly with the overlapping portion It is an aspect of the present invention to provide a coil structure for a high frequency transformer, in which the coil structure is used on a secondary side of the transformer, comprising at least one continuous conductive planar coil structure mentioned above, wherein the first output terminal and the second output terminal are respectively connected to a first switch and a second switch, and the first and the second switch are mutually connected to a first connecting plate.

Preferably, coil structure for a high frequency transformer includes a second connecting plate connected to the first switch and the second switch, wherein the second connecting plate comprises a control circuit, an absorption circuit and a protection circuit thereon. The third output terminal is connected to a conductor and has an opening thereon. The conductor is a rod shaped conductor passing through the opening.

The above aspects and advantages of the present invention will become more readily apparent to those ordinarily skilled in the art after reviewing the following detailed description and accompanying drawings, in which:

BRIEF DESCRIPTION OF THE DRAWINGS

FIG. 4(*b*) is a diagram showing the waveforms of currents passing through each switch and the center tap (i.e. on the output inductor L).

FIG. 4(*c*) is a diagram showing the harmonic spectra of the current $i_3$ passing through the center tap.

FIG. 4(*d*) is a diagram showing the harmonic spectra of the currents $i_1$ and $i_2$ passing through the switches S1 and S2.

FIG. 5(*b*) is a side view showing the folded structure of the continuous conductive planar coil structure shown in FIG. 5(*a*).

FIG. 5(*c*) is a top view showing the coil structure shown in FIG. 5(*b*).

FIG. 5(*d*) is a schematic top view showing the output terminals overlap one another in part.

FIG. 6(*b*) is a side view showing the folded structure of the continuous conductive planar coil structure shown in FIG. 6(*a*).

FIG. 7(*b*) is a side view showing the folded structure of the continuous conductive planar coil structure shown in FIG. 7(*a*).

FIG. 8(*b*) is an unfolded view showing a variation of the continuous conductive planar coil structure shown in FIG. 6(*a*).

FIG. 8(*c*) is an unfolded view showing a variation of the continuous conductive planar coil structure shown in FIG. 7(*a*).

FIG. 10(*b*) is a side view showing the folded structure of the continuous conductive planar coil structure shown in FIG. 10(*a*), wherein the switches are assembled on the output terminals.

FIG. 10(*c*) is a top view showing the coil structure shown in FIG. 10(*b*).

DETAILED DESCRIPTION OF THE PREFERRED EMBODIMENT

Figure 1:
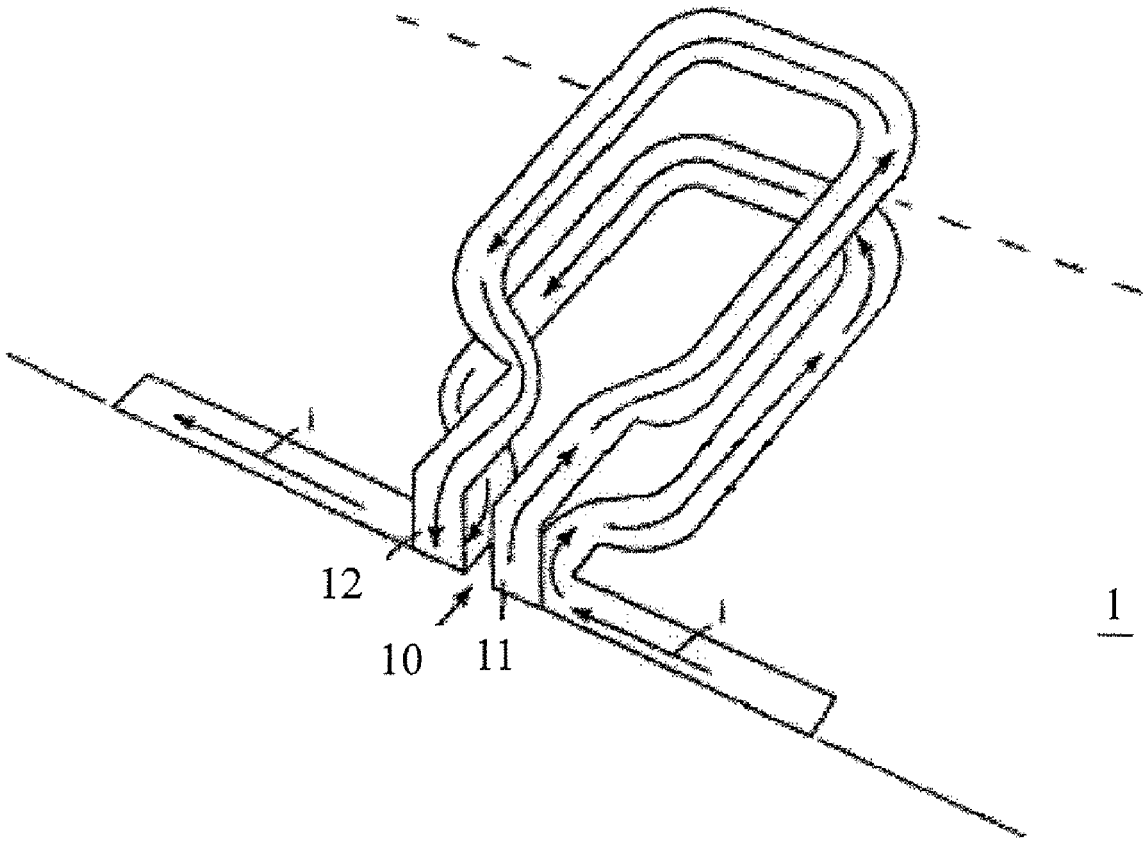
Fig. 1 (PRIOR ART)
FIG. 1 is a side view of a coil structure disclosed in U.S. Pat. No. 6,577,220.

The invention is described more specifically with reference to the following embodiments. It is to be noted that the following descriptions of preferred embodiments of this invention are presented herein for the purpose of illustration and description only; it is not intended to be exhaustive or to be limited to the precise form disclosed.

Please refer to FIG. 5(*a*) showing a continuous conductive planar coil structure according the first preferred embodiment of the present invention. In FIG. 5(*a*), the continuous conductive planar coil structure 5 includes a first three-fourths circular path 51, a second three-fourths circular path 52, an output terminal 53, an output terminal 54 and a first half-circular path 55.

The first three-fourths circular path 51 is connected to the output terminal 53, the second three-fourths circular path 52 is connected to the output terminal 54, and the output terminal 53 and the output terminal 54 are toward the same direction. In addition, a continuous conductive path between the output terminal 53 and the output terminal 54 is formed by the first three-fourths circular path 51, the second three-fourths circular path 52 and the first half-circular path 55.

The first half-circular path 55 is connected to the first three-fourths circular path 51 via the connecting portion AA', and connected to the second three-fourths circular path 52 via the connecting portion BB'. The half-circular path 55 is positioned on the extending direction of the continuous conductive planar path for separating the first three-fourths circular path 51 and the second three-fourths circular path 52, and has an opening toward a direction opposite to the direction, which the output terminals 53 and 54 are toward.

The continuous conductive planar coil structure of the present invention is formed by the non-contact folding of the first three-fourths circular path 11, the second three-fourths circular path 52 and the first half-circular path 55 via the connecting portions AA' and BB', in which a circular projection is vertically formed by the first three-fourths circular path 51, the second three-fourths circular path 52 and the first half-circular path 55, and the vertical projections of the output terminals 53 and 54 are substantially completely superposed.

Please refer to FIG. 5(*b*) showing the side view of the folded structure of the continuous conductive planar coil structure shown in FIG. 5(*a*). The folded continuous conductive planar coil structure is formed by that the connecting portion AA' is used as the axis for the first three-fourths circular path 51 to be turned left, the connecting portion BB' is used as the axis for the second three-fourths circular path 52 to be turned left, and the first half-circular path 55 is disposed between the first three-fourths circular path 51 and the second three-fourths circular path 52. Accordingly, two planes in parallel are formed by the output terminals 53 and 54.

Figure 2:
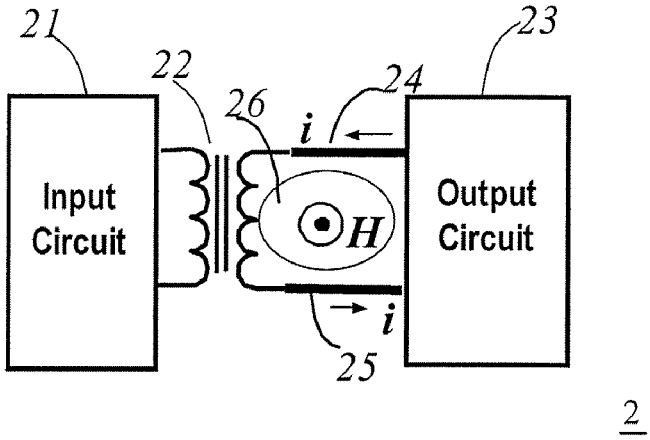
Fig. 2 (PRIOR ART)
FIG. 2 is a diagram showing the structure of a DC/DC converter according to the prior art.

When the continuous conductive planar coil structure 5 shown in FIG. 5(*b*) is used in the DC/DC converter 2 shown in FIG. 2, the area of the AC current loop 26 in FIG. 2 is significantly reduced due to the overlap of the output terminals 53 and 54. Although the proximity effect still exists which makes the current concentrates on the two surfaces of the output terminals 53 and 54 face to each other, the power loss is reduced greatly due to the overlapped planes of the two output terminals 53 and 54 having the large areas. Accordingly, the concentration of the current on the edges of the conductor shown in FIG. 1 is avoided.

FIG. 5(*c*) is the top view of the coil structure shown in FIG. 5(*b*). The shadow portion 58 is the projection formed by the overlapped part of the output terminals, and since the output terminals are superposed it is also the projection of the output terminals. The shadow portion 58 is encompassed by the boundary 56 between the projection 561 formed by the coil body and the projection 58 formed by the output terminal and the boundary 57 of the projection 58.

FIG. 5(*d*) is the top view of the coil structure with non-complete overlap of output terminals. In FIG. 5(*d*), the projection of the output terminal 54 is encompassed by the boundaries 56, 571, 572 and 573, and the projection of the output terminal 53 is encompassed by the boundaries 56, 573, 574 and 575. In contrast with FIG. 5(*c*), the projection 59 overlaps the projection of any output terminal in FIG. 5(*d*) in part; however, while the ratio of the area of the projection 59 to the area of the projection of any output terminal is more than 10%, the loss on the output terminal is significantly reduced.

There are various ways for folding the continuous conductive planar coil structure shown in FIG. 5(*a*). The connecting portion AA' is used as the axis for the first three-fourths circular path 51 to be turned right, and the connecting portion BB' is used as the axis for the second three-fourths circular path 52 to be turned left, so that the first half-circular path 55 is not positioned between the first three-fourths circular path 51 and the second three-fourths circular path 52. Accordingly, the first three-fourths circular path 51 is more close to the second three-fourths circular path 52, and the loss of the output terminals due to the proximity effect is further reduced.

In the continuous conductive planar coil structure 5 shown in FIG. 5(*a*), the coil is an arc-shaped. In practice, there are various coils of various shapes for different magnetic cores. For example, the coil can be rectangular. The coil structures in the following embodiments can also be changed with the structures of the magnetic cores.

In addition, the coil structure in FIG. 5(*a*) is a continuous conductive planar coil structure. In practice, the three conductors are separated from the connecting portions AA' and BB', positioned as the structure shown in FIG. 5(*b*), and soldered via the connecting portions AA' and BB' for the electrical connection. The continuous conductive planar coil structures in the following figures can also be fabricated in this way.

Figure 6A:
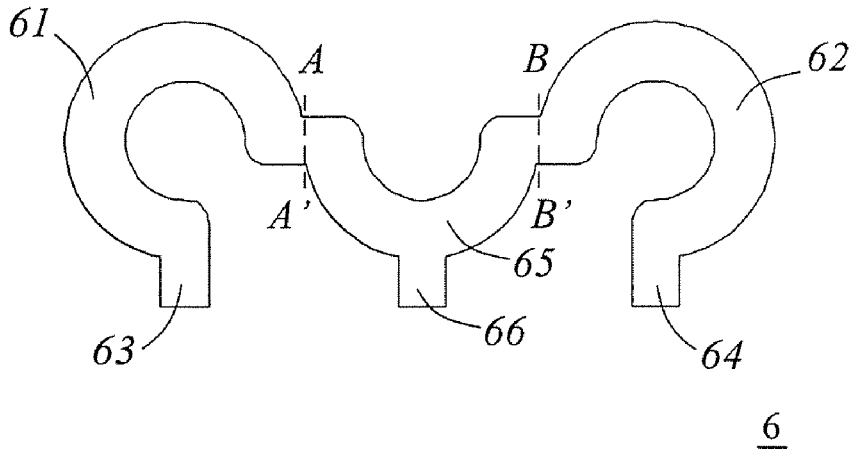
FIG. 6(*a*) is an unfolded view showing the continuous conductive planar coil structure according to the second embodiment of the present invention.
Figure 6B:
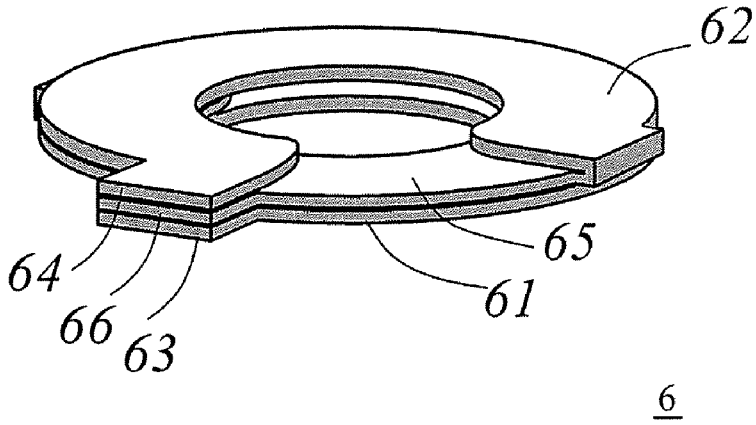

Please refer to FIG. 6(*a*) showing the continuous conductive planar coil structure according to the second embodiment of the present invention. In contrast with FIG. 5(*a*), FIG. 6(*a*) shows the coil structure which is applied in the transformer whose secondary side is the center tap structure.

In FIG. 6(*a*), the continuous conductive planar coil structure 6 includes the three-fourths circular paths 61 and 62, the first half-circular path 65 and the output terminals 63 and 64 connected in series, wherein the output terminal 66 is positioned on the half-circular path 65 as the center tap. The connecting portions AA' and BB' are used as axes for the three-fourths circular paths 61 and 62 to be turned left, the half-circular path 65 is positioned between the three-fourths circular paths 61 and 62, so as to form the continuous conductive planar coil structure 6 shown in FIG. 6(*b*). The output terminals 63, 64 and 66 are close to one another, and the vertical projections thereof substantially completely overlap one another, so as to reduce the area of the AC current loop and minimize the power loss due to the proximity effect. Similarly, the coil structure can be folded in the above-mentioned manner, in which the three-fourths circular paths 61 and 62 are respectively turned left and right relatively with the connecting portions AA' and BB' as the axes, and the first half-circular path 65 is disposed outside the three-fourths circular paths 61 and 62.

Figure 3:
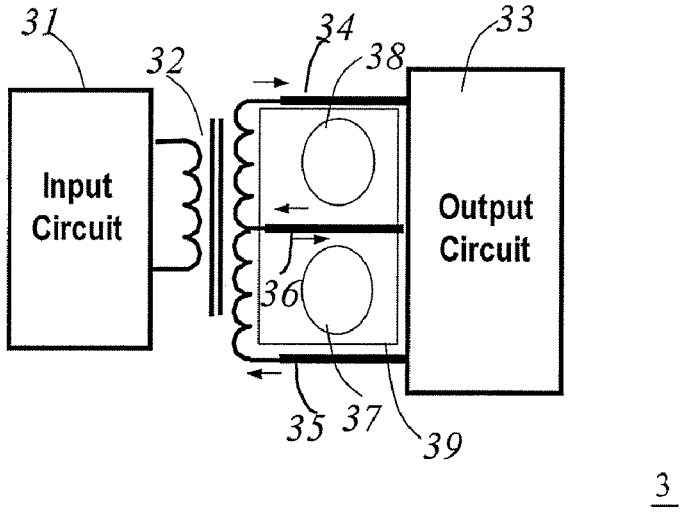
Fig. 3 (PRIOR ART)
FIG. 3 is a diagram showing the structure of another DC/DC converter according to the prior art.
Figure 4A:
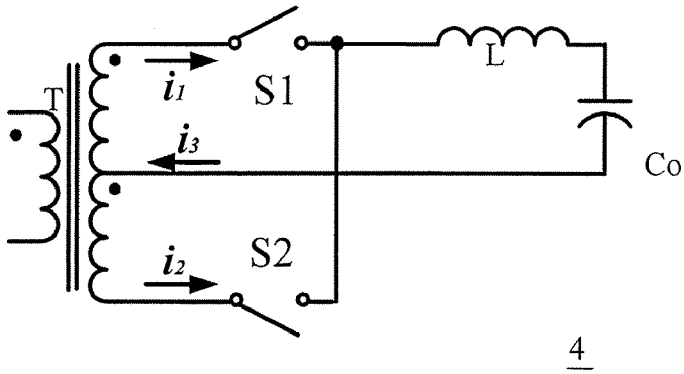
Fig. 4(a) (PRIOR ART)
FIG. 4(*a*) is a diagram showing a voltage type full-wave rectifier circuit according to the prior art.
Figure 4B:
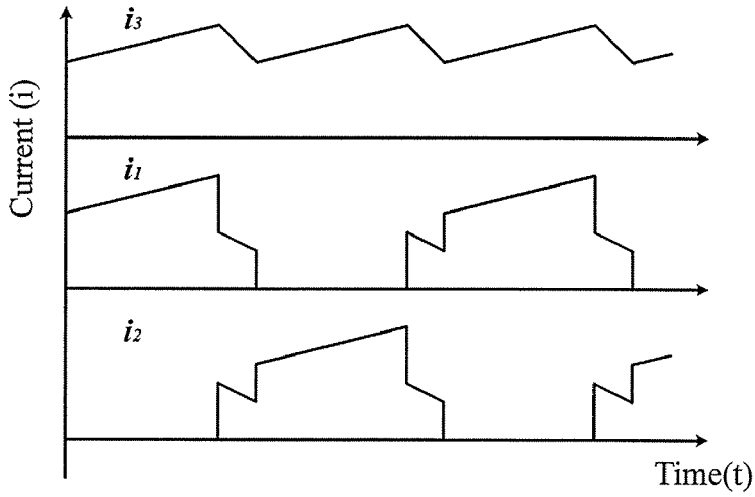
Fig. 4(b) (PRIOR ART)
Figure 4C:
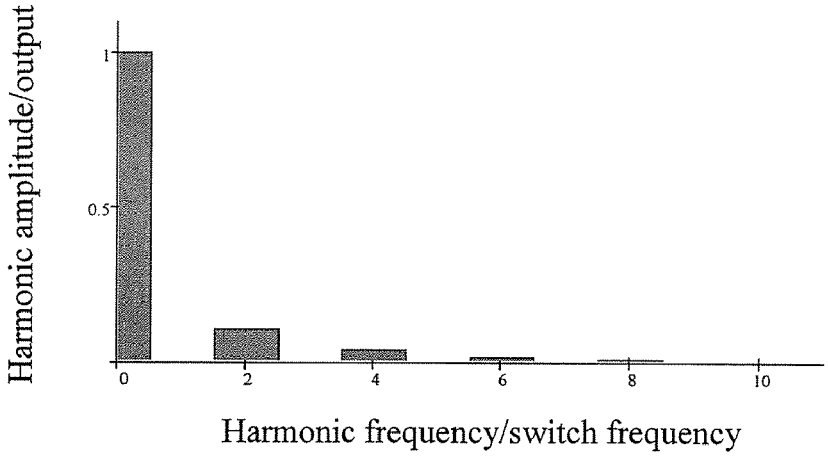
Fig. 4(c) (PRIOR ART)
Figure 4D:
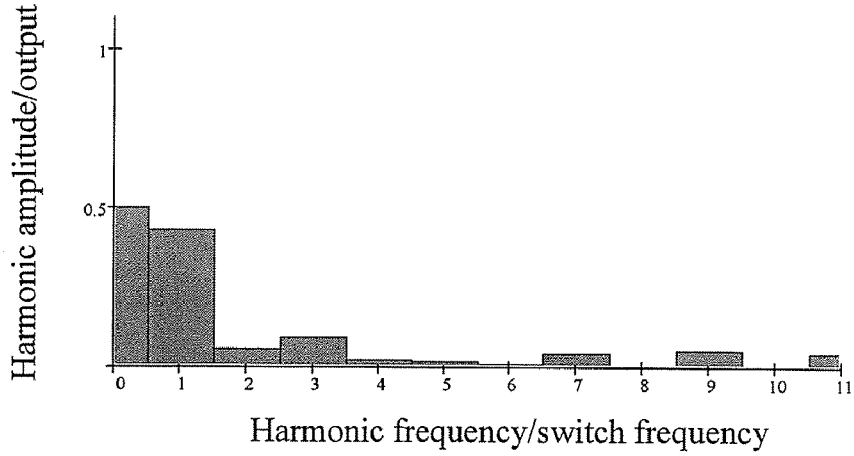
Fig. 4(d) (PRIOR ART)
Figure 5A:
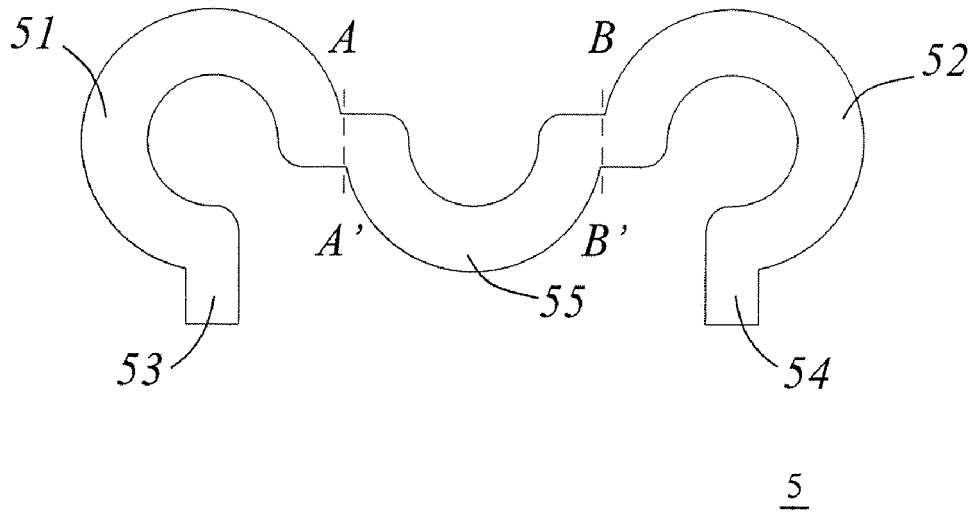
FIG. 5(*a*) is a schematic view showing the continuous conductive planar coil structure according to the first embodiment of the present invention.
Figure 5B:
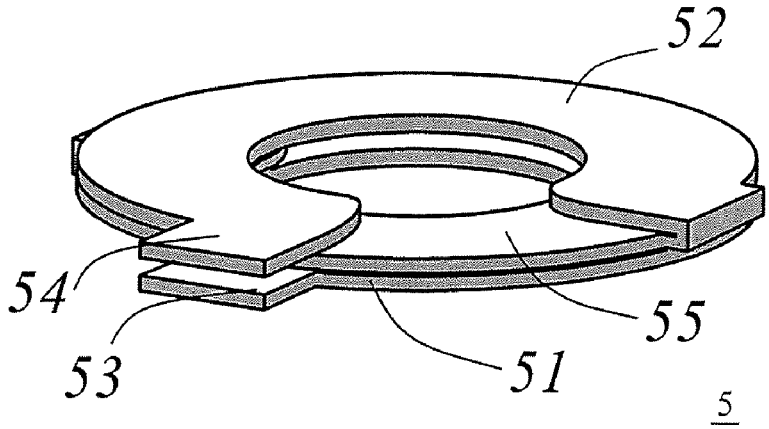
Figure 5C:
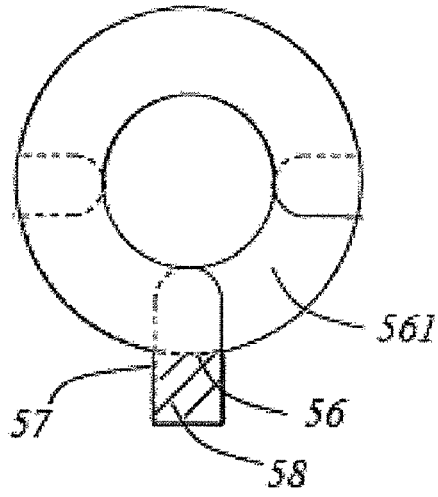
Figure 5D:
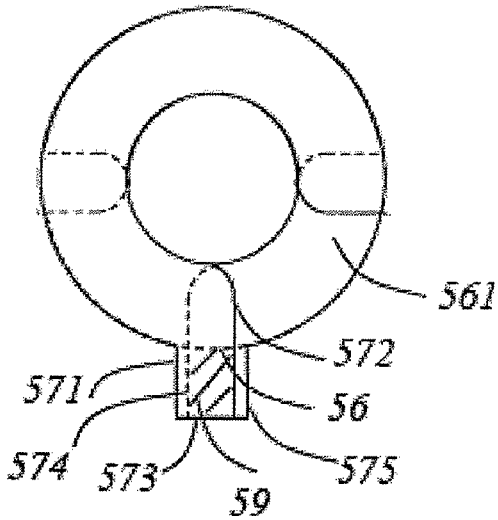
Figure 7A:
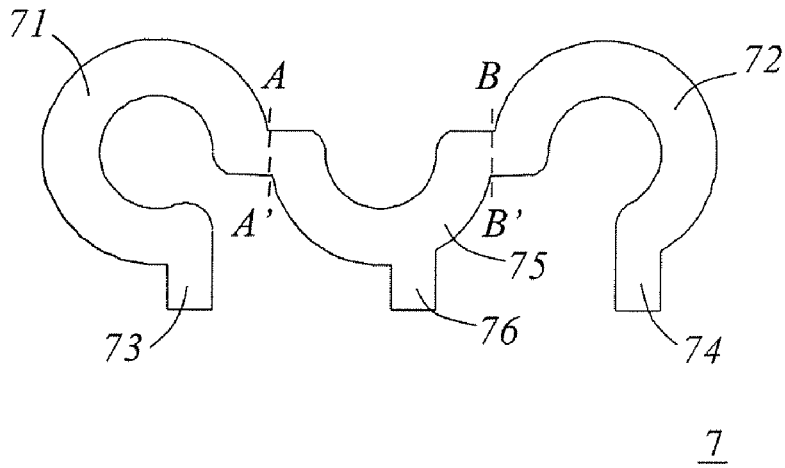
FIG. 7(*a*) is an unfolded view showing the continuous conductive planar coil structure according to the third embodiment of the present invention.
Figure 7B:
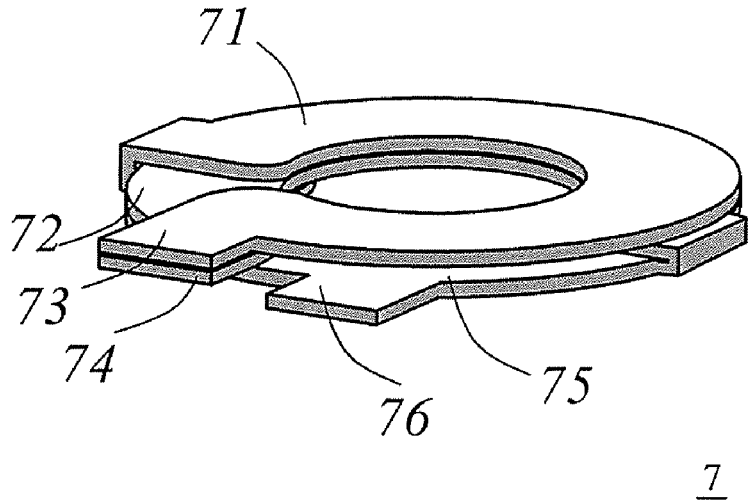

Please refer to FIG. 7(*a*) showing the continuous conductive planar coil structure according to the third embodiment of the present invention. The coil structure is applied in the transformer whose secondary side is the center tap structure, and is suitable for the DC/DC converter 3 shown in FIG. 3.

In FIG. 7(*a*), the continuous conductive planar coil structure 7 includes the three-fourths circular paths 71 and 72, the half-circular path 75 and the output terminals 73 and 74 connected in series, in which the half-circular path 75 has the output terminal 76 thereon as the center tap.

Please refer to FIG. 7(*b*), which is the side view showing the folded structure of the continuous conductive planar coil structure shown in FIG. 7(*a*). The connecting portions AA' and BB' are used as axes for the three-fourths circular paths 71 and 72 to be turned left and right, respectively, and the half-circular path 75 is positioned outside the three-fourths circular paths 71 and 72. The output terminals 73 and 74 are close to each other, and the vertical projections thereof substantially completely overlap each other. The projection of the output terminal 76 is separated from the vertical projections which means that they do not overlap each other.

As previously mentioned, in the center tapped transformer, the odd-order harmonics of current flowing in the output terminals 73, 74 have identical quantities and reverse directions. Therefore, the complete overlap of the off-terminals 73 and 74 can reduce not only the area of the AC component loop of the odd-order harmonics but also the power loss due to the proximity effect. The number of turns in the continuous conductive planar coil structures shown in FIGS. 5(*a*), 6(*a*) and 7(*a*) is two ($\frac{3}{4}+\frac{1}{2}+\frac{3}{4}=2$). However, in practice, the number of turns can be increased, and the output terminals still completely overlap one another. As shown in the continuous conductive planar coil structure 81 in FIG. 8(*a*), the number of turns in the coil is four ($\frac{3}{4}+\frac{1}{2}*5+\frac{3}{4}$).

Figure 8A:
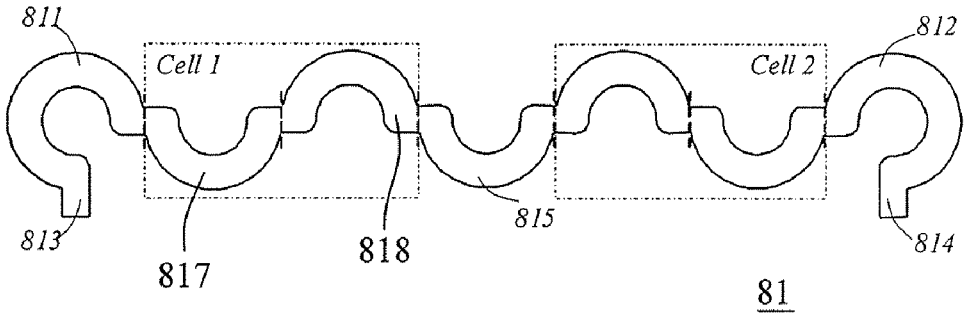
FIG. 8(*a*) is an unfolded view showing a variation of the continuous conductive planar coil structure shown in FIG. 5(*a*).
Figure 8B:
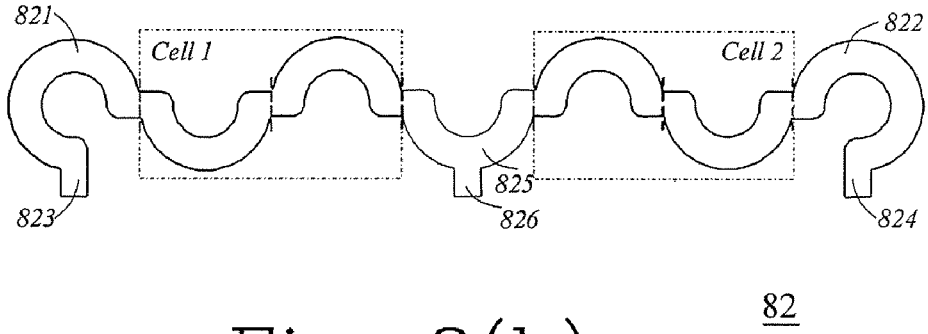
Figure 8C:
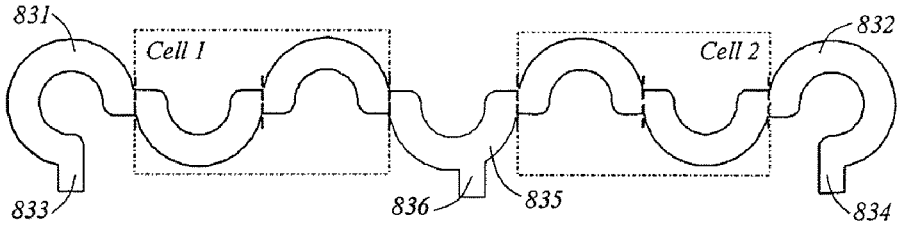

Please refer to FIG. 8(*a*) showing a variation of the continuous conductive planar coil structure shown in FIG. 5(*a*). In FIG. 8(*a*), the path units Cell 1 and Cell 2 are respectively disposed between the first three-fourths circular path 811 and the first half-circular path 815 and between the second three-fourths circular path 812 and the first half-circular path 815 for separating the first three-fourths circular path 811 and the second three-fourths circular path 812 on the extending direction of the continuous conductive planar path. The path unit Cell 1 includes the adjacent second half-circular path 817 and third half-circular path 818. The openings of the adjacent half-circular paths between the first three-fourths circular path 811 and the second three-fourths circular path 812 are towards directions opposite to each other.

As above-mentioned, the non-contact folding of the first three-fourths circular path 811, the second three-fourths circular path 812 and the half-circular paths are horizontally formed on junctions among the first three-fourths circular path 811, the second three-fourths circular path 812 and the half-circular paths, so that a circular projection is vertically formed. The vertical projections formed by the output terminals 813 and 814 completely overlap each other. Accordingly, the continuous conductive planar coil structure 81 with four turns is formed.

Similarly, FIG. 8(*b*) and FIG. 8(*c*) shows the variations of the continuous conductive planar coil structures shown in FIG. 6(*a*) and FIG. 7(*a*), respectively, wherein the number of coil turns is four.

Accordingly, if the amounts of the path units respectively disposed between the first three-fourths circular path and the first half-circular path and between the second three-fourths circular path and the half-circular path are identical, the number of turns in the coil can be optionally increased (□3), in which the number of turns is ¾+½+¾+m, and m is the number of the path units.

In the continuous conductive planar coil structure shown in FIG. 8, the conduction loss on the output circuit is increased owing to the increased output current. Therefore, the conduction loss on the output circuit is significantly reduced due to the reduction of the output path. In addition, the efficiency of the circuit can be increased due to the reduction of the parasite inductance etc.

Figure 9:
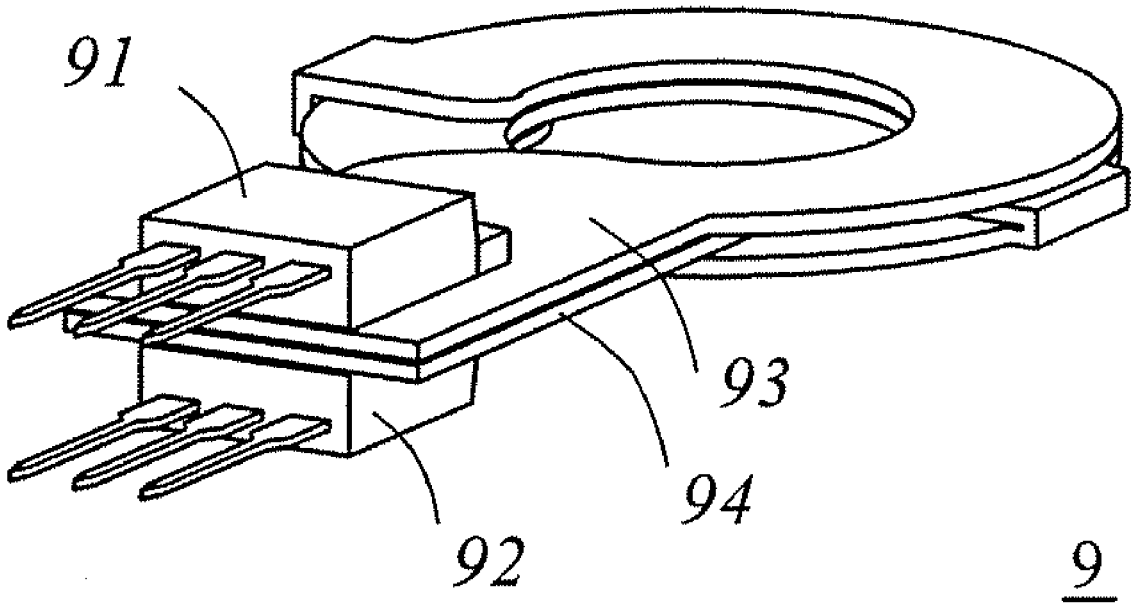
FIG. 9 is a schematic view showing the continuous conductive planar coil structure according to the fourth embodiment of the present invention.

Please refer to FIG. 9 showing the continuous conductive planar coil structure according to the fourth embodiment of the present invention. The continuous conductive planar coil structure 9 includes only two output terminals 93 and 94, and the switches 91 and 92 of the output circuit are directly installed on the output terminals 93 and 94 which are also used as the heatsink for the switches. Accordingly, the conduction loss is reduced greatly.

Figure 10A:
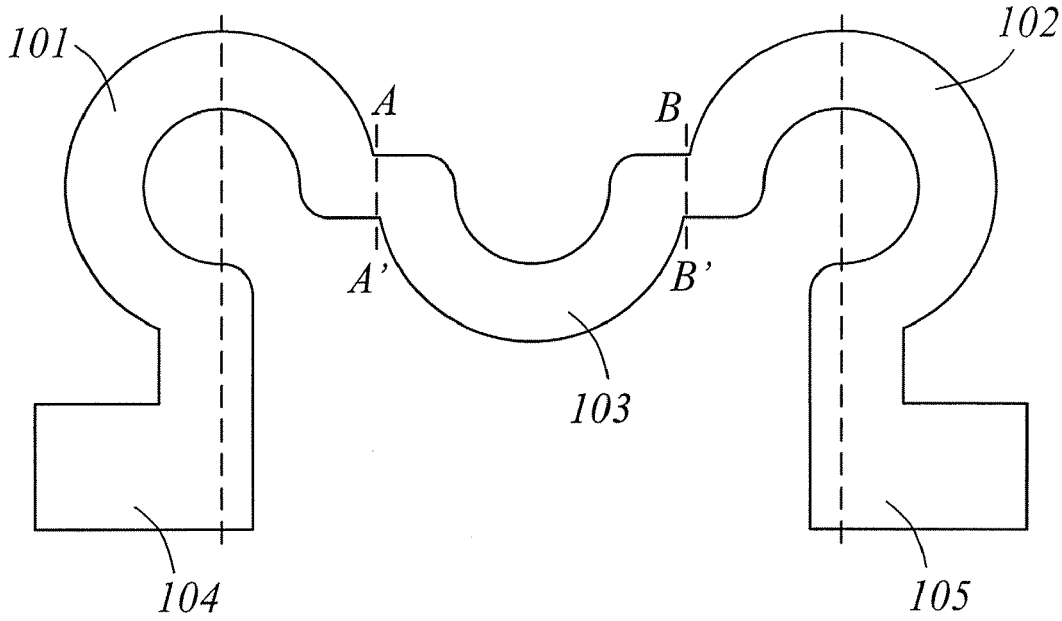
FIG. 10(*a*) is an unfolded view showing the continuous conductive planar coil structure according to the fifth embodiment of the present invention.
Figure 10B:
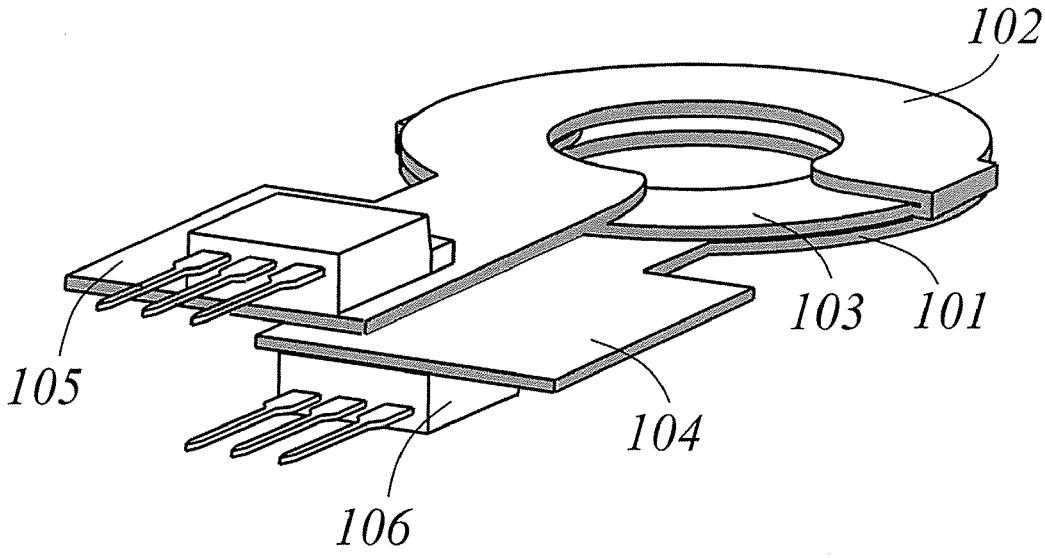
Figure 10C:
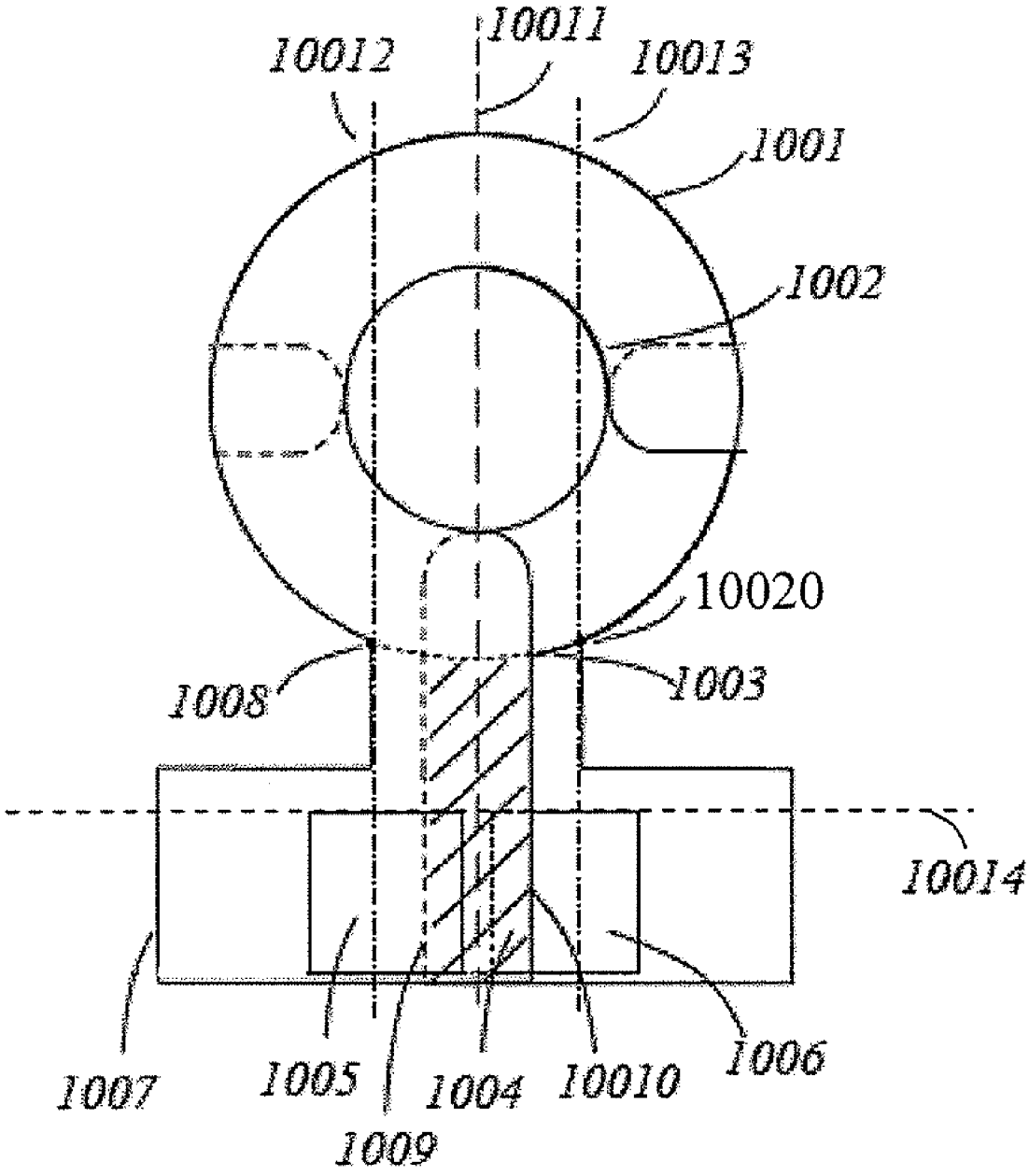

Please refer to FIG. 10(*a*) showing the continuous conductive planar coil structure according to the fifth embodiment of the present invention, in which the output terminals overlap one another in part. In contrast with the coil structure shown in FIG. 5, the area of the output terminal in the coil structure is larger, so that the heat-dissipating effect is better for the coil body and the switches. In FIG. 10(*a*), the continuous conductive planar coil structure includes the first partial circular path 101, the second partial circular path 102, the output terminal 104, the output terminal 105 and the first half-circular path 103.

The first half-circular path 103 is connected to the first partial circular path 101 via the connecting portion AA' and connected to the second partial circular path 102 via the connecting portion BB' for separating the first partial circular path 101 and the second partial circular path 102 on the extending direction of the continuous conductive planar path.

Please refer to FIG. 10(*b*) showing the folded structure of the continuous conductive planar coil structure shown in FIG. 10(*a*), wherein the switches are assembled on the output terminals. The connecting portion AA' is used as the axis for the first partial circular path 101 to be turned left, and the connecting portion BB' is used as the axis for the second partial circular path 102 to be turned left. The first half-circular path 103 is positioned between the first partial circular path 101 and the second partial circular path 102. Two planes formed by the output terminals 104 and 105 are paralleled. The output terminals 104 and 105 overlap each other in part.

Please refer to FIG. 10(*c*) showing a top view of the coil structure shown in FIG. 10(*b*). The first projection region is formed by the partial circular paths 101 and 102 and the half-circular path 103, and is demarcated by the concentric circles 1001 and 1002. The second projection region is formed by the output terminals 104 and 105, with whose boundaries comprise the dotted line 1003 and the line 1007. The third projection region 1004 is formed by the overlapping portion of the output terminals 104 and 105, whose boundaries comprise the lines 1009 and 10010, in which the third projection region 1004 is positioned in the first projection region. The dotted line 10011 is the symmetric axis for the first projection region. The concentric circle 1001 crosses the line 1007 at the points 1008 and 10020. The dotted lines 10012 and 10013 respectively passing through the points 1008 and 10020 are parallel to the axis 10011. The portions 1005 and 1006 in the second projection region are the projections formed by the switches shown in FIG. 10(*b*) (If the switches in FIG. 10(*b*) are SMD packaged, then its projections thereof have regular shapes just as that shown in FIG. 10(*c*). While in practice, there are various forms of package for switches, such as TO-220 or TO-247 as shown in FIG. 10(*b*), in which the corresponding projections thereof have irregular shapes including the projections of the switch body and the pines.) Many lines perpendicular to the dotted line 10011 can be made which is across the points on the boundaries of the portions 1005 and 1006, wherein the line has the minimal distance to the point 1008 (or the point 10020) can be obtained which is depicted as the dotted line 10014. If the area of the third projection region 1004 is more than 5% of the area demarcated by the dotted lines 1003, 10012, 10013 and 10014, the loss on the output terminals is significantly reduced.

Figure 11:
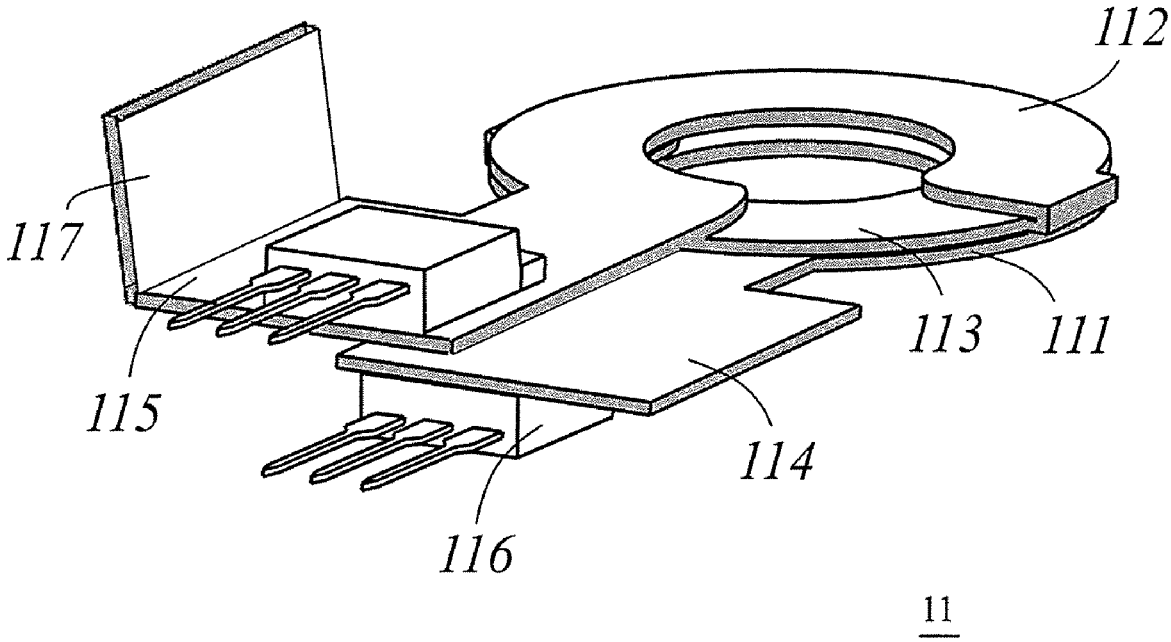
FIG. 11 is a schematic view showing the continuous conductive planar coil structure according to the sixth embodiment of the present invention.

In the previous embodiments, the plane of the output terminal is parallel to the plane of the folded continuous conductive planar coil structure, which means the output terminals are positioned on the same plane. In practice, the output terminals may be positioned on plenty of planes. In contrast with FIG. 10(*b*), the output terminal 115 and the output terminal 112 are not exactly positioned on the same plane in FIG. 11, since the output terminal 115 further includes the conductor 117.

Figure 12:
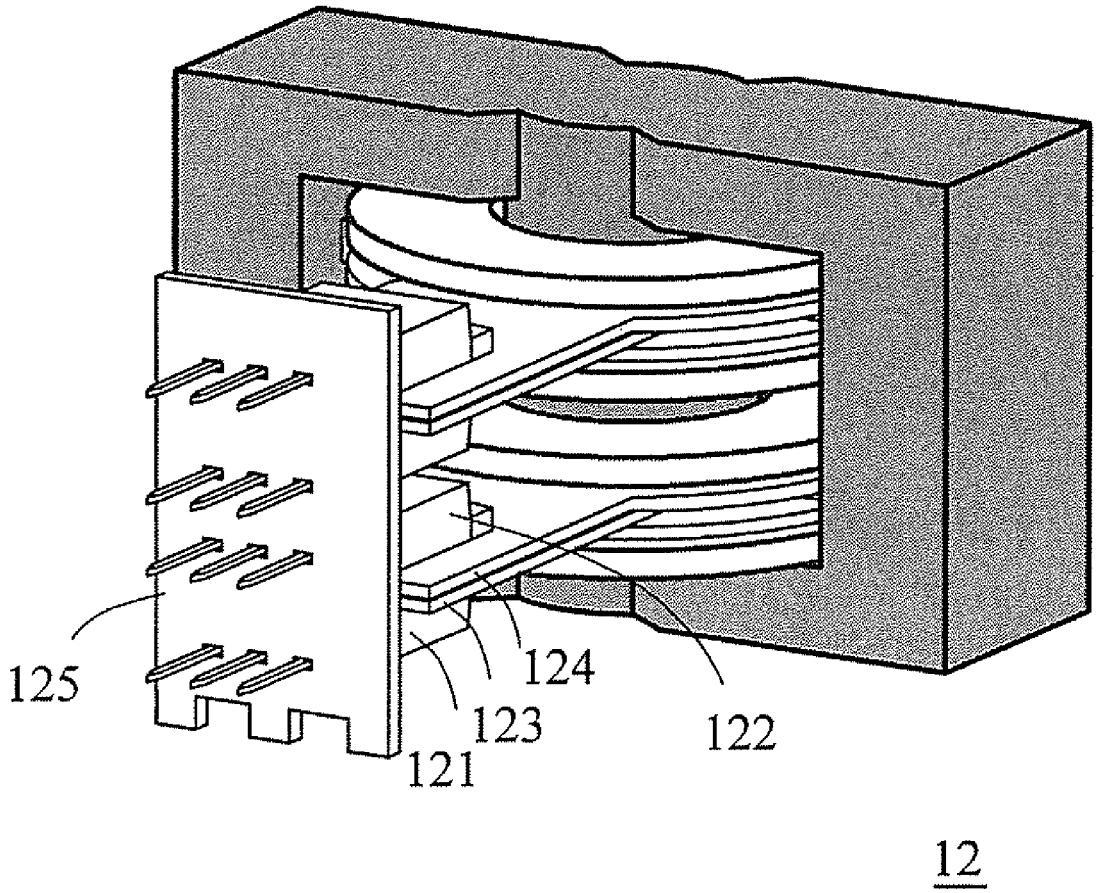
FIG. 12 is a side view showing a coil structure for a high frequency transformer according to the embodiment of the present invention.

Please refer to FIG. 12 showing a side view of a coil structure for a high frequency transformer according to the embodiment of the present invention. The continuous conductive planar coil structure 9 shown in FIG. 9 is used as the output unit on the secondary side of the transformer, and the multiple output units are assembled to form the coil structure 12 for the output circuit on the secondary side of the high frequency transformer as shown in FIG. 12. In FIG. 12, a connecting plate 125 is used to connect the switches of the output units, such as the switches 121 and 122, so that the output units can be connected in series or in parallel. The connecting plate 125 can be a circuit board or a metal conductor such as a copper plate for providing the electrical connection to the switches.

Figure 13:
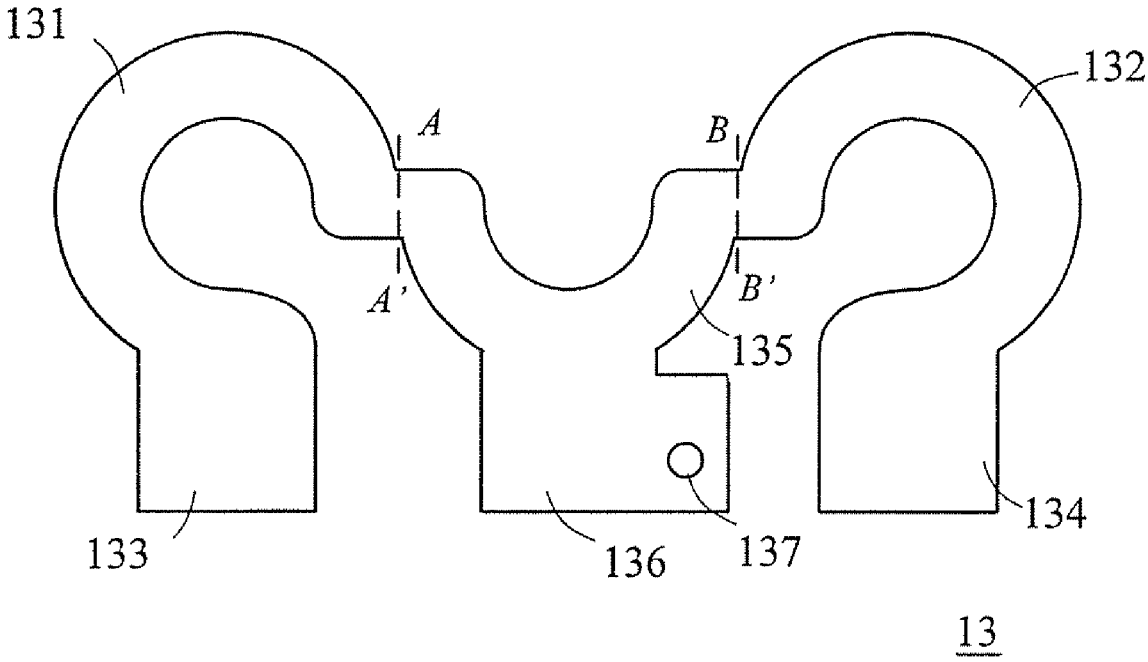
FIG. 13 is an unfolded view showing the continuous conductive planar coil structure according to the sixth embodiment of the present invention.
Figure 14:
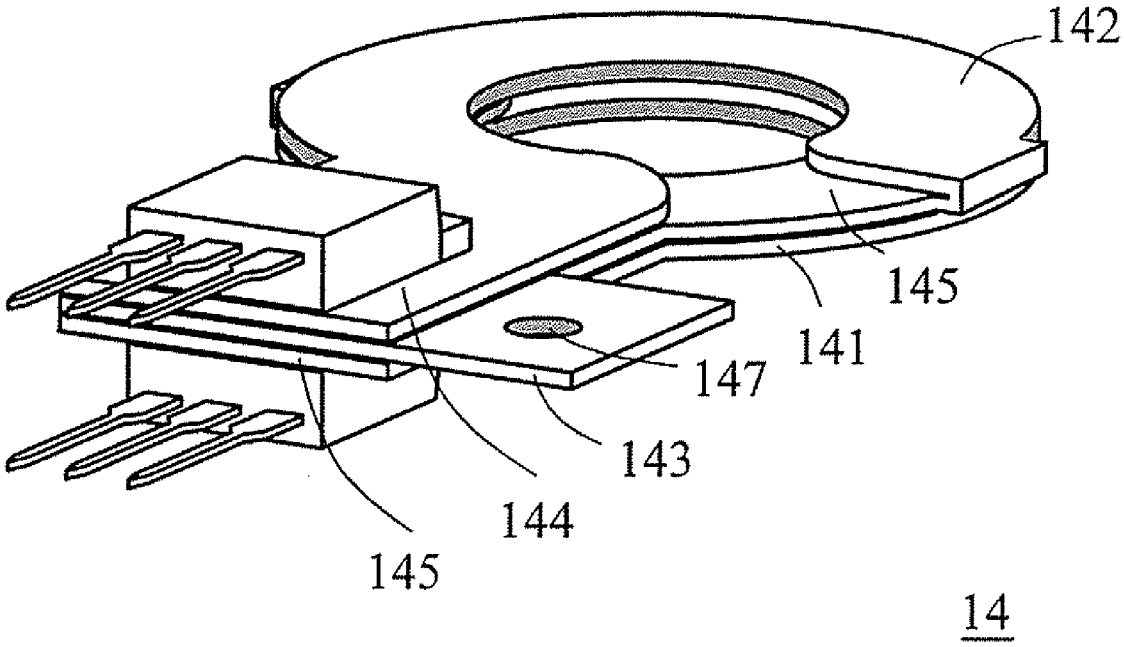
FIG. 14 is a side view showing the folded structure of the continuous conductive planar coil structure shown in FIG. 13.

Please refer to FIG. 13 showing the continuous conductive planar coil structure according to the sixth embodiment of the present invention, in which the continuous conductive planar coil structure 13 has the center tap. As shown in FIG. 14, the projections formed by the output terminals 143, 144 and 145 of the continuous conductive planar coil structure 14 overlap one another in part, and the output terminal 143 has an opening 147 thereon.

Figure 15:
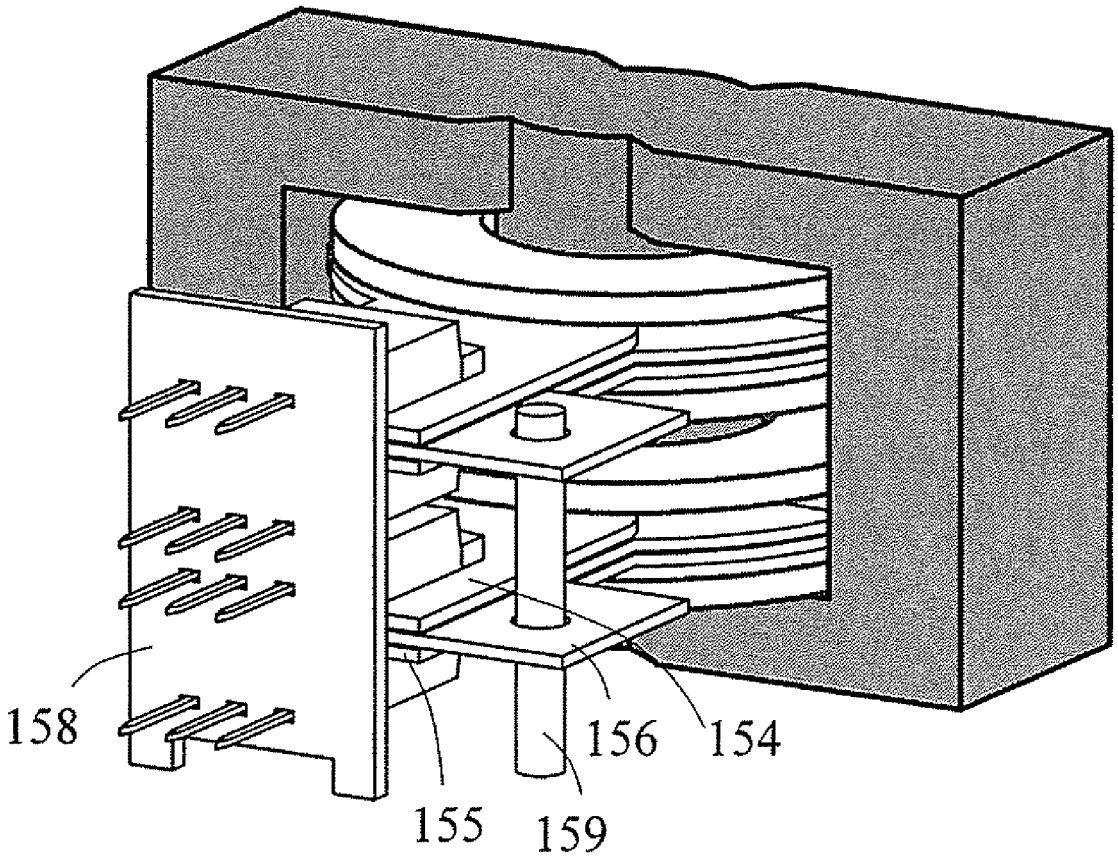
FIG. 15 is a side view showing a coil structure for a high frequency transformer according to the embodiment of the present invention.

The continuous conductive planar coil structure 14 shown in FIG. 14 is used as the output unit on the secondary side of the transformer, and the multiple output units are assembled to form the coil structure 15 shown in FIG. 15 for the output circuit on the secondary side of the high frequency transformer, wherein FIG. 15 is the side view of the coil structure for the high frequency transformer according to the embodiment of the present invention. Similarly, the switches are connected via the connecting plate 158, so that the output units can be connected in series or in parallel. The conductor 159 can be installed in the openings of the center taps of the output units.

Figure 16:
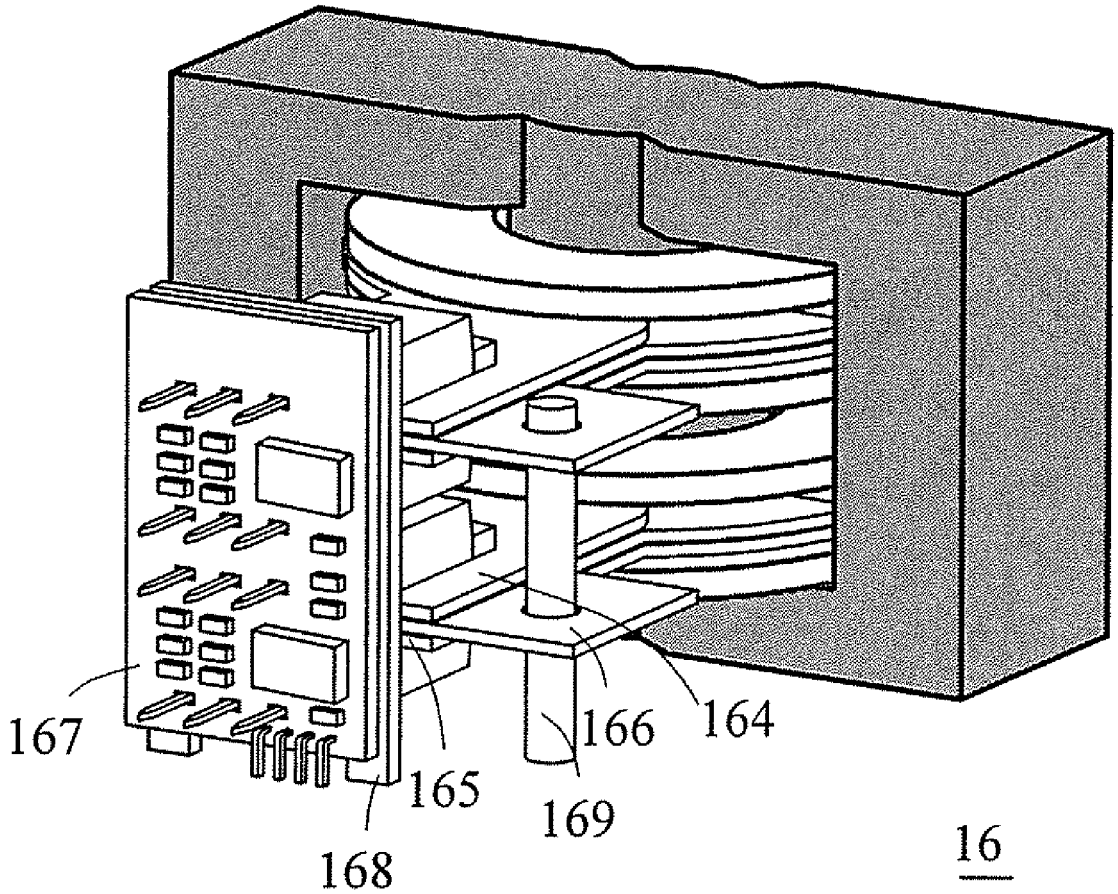
FIG. 16 is a side view showing a coil structure for a high frequency transformer according to the embodiment of the present invention.

Please refer to FIG. 16 showing the side view of the coil structure for a high frequency transformer according to another embodiment of the present invention. In FIG. 16, the coil structure 16 has an additional connecting plate 167 for connecting the switches, and the connecting plate 167 has the control circuit, the absorption circuit and the protection circuit thereon.

Accordingly, the present invention provides the continuous conductive planar coil structure for effectively reducing the proximity effect among conductors and reducing the interferences from the electromagnetic radiation.

While the invention has been described in terms of what is presently considered to be the most practical and preferred embodiments, it is to be understood that the invention needs not be limited to the disclosed embodiment. On the contrary, it is intended to cover various modifications and similar arrangements included within the spirit and scope of the appended claims which are to be accorded with the broadest interpretation so as to encompass all such modifications and similar structures.

The invention claimed is:

1. A continuous conductive planar coil structure, comprising a first output terminal;

a second output terminal;

a coil body; and a projection plane parallel to the coil body, wherein a first projection on the projection plane is formed by the first output terminal, a second projection on the projection plane is formed by the second output terminal, and an overlapping portion is formed by the first projection and the second projection.

2. The continuous conductive planar coil structure according to claim 1, wherein the first projection has a first area, the second projection has a second area, the overlapping portion has a third area, and one of a ratio of the third area to the first area and a ratio of the third area to the second area is more than 10%.

3. The continuous conductive planar coil structure according to claim 2, comprising a first switch connected to the first output terminal and a second switch connected to the second output terminal.

4. A coil structure for a high frequency transformer, in which the coil structure is used on a secondary side of the transformer, comprising a continuous conductive planar coil structure claimed in claim 3, wherein the first switch and the second switch mutually connect to a first connecting plate, and the first connecting plate provides an electrical connection between the first switch and the second switch.

5. The continuous conductive planar coil structure according to claim 1, wherein the coil body comprises:

a continuous conductive planar path positioned between the first output terminal and the second output terminal and including:

a first three-fourths circular path connected to the first output terminal;

a second three-fourths circular path connected to the second output terminal; and a first half-circular path connected between the first three-fourths circular path and the second three-fourths circular path and separating the first three-fourths circular path and the second three-fourths circular path on an extending direction of the continuous conductive planar path, wherein the first half-circular path has an opening toward a first direction, the first output terminal and the second output terminal are toward a second direction, and the first direction is opposite to the second direction, wherein non-contact folding of the first three-fourths circular path, the second three-fourths circular path and the first half-circular path are horizontally formed on junctions among the first three-fourths circular path, the second three-fourths circular path and the first half-circular path, so that a first circular projection is vertically formed by the first three-fourths circular path, the second three-fourths circular path and the first half-circular path.

6. The continuous conductive planar coil structure according to claim 5, wherein the first projection and the second projection substantially completely overlap each other.

7. The continuous conductive planar coil structure according to claim 5, comprising at least two path units respectively disposed between the first three-fourths circular path and the first half-circular path and between the second three-fourths circular path and the first half-circular path on the extending direction of the continuous conductive planar path for separating the first three-fourths circular path and the second three-fourths circular path, wherein each of the path units includes:

a second half-circular path; and a third half-circular path connected to the second half-circular path, wherein adjacent half-circular paths between the first three-fourths circular path and the second three-fourths circular path respectively have a third opening toward a third direction and a fourth opening toward a fourth direction opposite to the third direction, and non-contact folding of the first three-fourths circular path, the second three-fourths circular path and the half-circular paths are horizontally formed on junctions among the first three-fourths circular path, the second three-fourths circular path and the half-circular paths, so that a second circular projection is vertically formed by the first three-fourths circular path, the second three-fourths circular path and the half-circular paths.

8. The continuous conductive planar coil structure according to claim 1, further comprising:

a third projection on the projection plane formed by the coil body;

a fourth projection formed by the first projection and the second projection, wherein a first boundary is the common boundary of those of the fourth projection and the third projection, the fourth projection has a second boundary, the first boundary and the second boundary intersect at a first point and a second point, the third projection is symmetric relatively to a first axis passing through the fourth projection, a second axis parallel to the first axis passes through the first point, and a third axis parallel to the first axis passes through the second point;

a first switch connected to the first output terminal and having a projection with a third boundary on the projection plane;

a second switch connected to the second output terminal and having a projection with a fourth boundary on the projection plane, wherein a first horizontal line perpendicular to the first axis intersects one of the third boundary and the fourth boundary, and a distance between the first horizontal line and the first point is relatively minimal;

a fifth projection demarcated by the first boundary, the second axis, the third axis and the first horizontal line; and a ratio of an area of the overlapping portion to an area of the fifth projection being more than 5%.

9. A coil structure for a high frequency transformer, in which the coil structure is used on a secondary side of the transformer, comprising a continuous conductive planar coil structure claimed in claim 8, wherein the first switch and the second switch mutually connect to a first connecting plate, and the first connecting plate provides an electrical connection between the first switch and the second switch.

10. The coil structure according to claim 9, further comprising a second connecting plate connected to the first switch and the second switch, wherein said second connecting plate comprises a control circuit, an absorption circuit and a protection circuit thereon.

11. The continuous conductive planar coil structure according to claim 8, further comprising:

a sixth projection demarcated by the first boundary, the second boundary, the second axis, the third axis and the first horizontal line; and a ratio of the area of the overlapping portion to an area of the sixth projection being more than 5%.

12. The continuous conductive planar coil structure according to claim 1, further comprising a third output terminal.

13. The continuous conductive planar coil structure according to claim 12, wherein a third projection on the projection plane is formed by the third output terminal.

14. The continuous conductive planar coil structure according to claim 13, wherein the third projection is separated from the overlapping portion.

15. The continuous conductive planar coil structure according to claim 13, wherein the third projection is overlapped partly with the overlapping portion.

16. A coil structure for a high frequency transformer, in which the coil structure is used on a secondary side of the transformer, comprising at least one continuous conductive planar coil structure claimed in claim 8, wherein the first output terminal and the second output terminal are respectively connected to a first switch and a second switch, and the first and the second switch are mutually connected to a first connecting plate.

17. The coil structure according to claim 16, further comprising a second connecting plate connected to the first switch and the second switch, wherein the second connecting plate comprises a control circuit, an absorption circuit and a protection circuit thereon.

18. The coil structure according to claim 17, wherein the third output terminal is connected to a conductor.

19. The coil structure according to claim 18, wherein the third output terminal has an opening thereon, and the conductor is a rod shaped conductor passing through the opening.

* * * * *

UNITED STATES PATENT AND TRADEMARK OFFICE

CERTIFICATE OF CORRECTION

PATENT NO. : 7,511,599 B2
APPLICATION NO. : 11/936930
DATED : March 31, 2009
INVENTOR(S) : Ye et al.

It is certified that error appears in the above-identified patent and that said Letters Patent is hereby corrected as shown below:

At claim 16, column 14, line 16, after "claim" delete "8" and insert --12--.

Signed and Sealed this

Fourth Day of August, 2009

JOHN DOLL
*Acting Director of the United States Patent and Trademark Office*